United States Patent [19]

Kallinich et al.

[11] Patent Number: 4,844,662

[45] Date of Patent: Jul. 4, 1989

[54] SEALING BARRIER FOR SUBTERRANEAN PURPOSES

[75] Inventors: Dietmar Kallinich, Gelsenkirchen; Wolfgang Kahlert, Castrop-Rauxel, both of Fed. Rep. of Germany

[73] Assignee: Flachglass Aktiengesellschaft, Furth, Fed. Rep. of Germany

[21] Appl. No.: 209,342

[22] Filed: Jun. 20, 1988

[30] Foreign Application Priority Data

Jun. 20, 1987 [DE] Fed. Rep. of Germany ..... 3720519

[51] Int. Cl.[4] ..... E02D 29/00; E02D 31/02

[52] U.S. Cl. ..... 405/265; 405/267

[58] Field of Search ..... 405/267, 266, 36, 128, 405/262, 284, 285, 286

[56] References Cited

U.S. PATENT DOCUMENTS

| | | | |
|---|---|---|---|
| 250,635 | 12/1881 | McLean | 405/284 X |
| 4,543,016 | 9/1985 | Tallard | 405/267 |
| 4,648,226 | 3/1987 | Manon | 52/308 |
| 4,679,965 | 7/1987 | Gläser et al. | 405/267 X |

FOREIGN PATENT DOCUMENTS

| | | | |
|---|---|---|---|
| 150819 | 8/1984 | Japan | 405/267 |
| 45820 | 2/1987 | Japan | 405/267 |

*Primary Examiner*—Dennis L. Taylor
*Assistant Examiner*—J. Russell McBee
*Attorney, Agent, or Firm*—Herbert Dubno

[57] ABSTRACT

A barrier in a subterranean structure is provided by the form of a sealing wall consisting of glass panels or panes in spaced-apart relationship within the packing mass between the panes and also embedding the sealing wall in the slit which is found in the subterranean structure.

15 Claims, 6 Drawing Sheets

SEALING BARRIER FOR SUBTERRANEAN PURPOSES

FIELD OF THE INVENTION

Our present invention relates to a sealing barrier for geological substructures, i.e. adapted to be placed in a ground structure and preventing permeation of fluids from one side of the barrier to the opposite side of the barrier. More particularly, the invention relates to a barrier formed in a substantially vertical slit in the ground and consisting essentially of a packing mass filling that slit within which a sealing wall is embedded.

BACKGROUND OF THE INVENTION

Subterranean sealing barriers are required for a variety of purposes and generally are intended to prevent migration of fluids from one side of the barrier to the opposite side thereof. While such barriers can be used as curtain walls, cofferdams and the like to prevent ground water from entering a protected area, they have found great importance recently as barriers to the passage of percolating, contaminating liquids from waste-disposal sites to protected regions around such sites.

In the past, it has been proposed to provide such barriers in the form of a so-called slit wall, i.e. a slit formed in the ground and filled with a barrier mass or provided internally with a barrier material which can be embedded in the mass. Generally speaking, such walls can extend down from the surface to rock strata or other geological formations which are impermeable to water and other fluids which may be contaminative or may be contaminating, to enclose the contaminated region and thereby prevent contamination of an adjoining area.

The sealing members in such systems may be vertically extending lamella or plates which are connected together contiguously, can have a thickness of 40 to 100 cm and a lamella width of, for example, 2 m or more.

The depth of the slit or structure can be 50 m or more, depending on the geological formations. The lamella can be composed of any nonpermeable material and the packing mass in which the sealing wall is embedded can be a mixture of bentonite, a hydraulic cement such as a Portland cement and water.

The purpose of the packing mass or mixture is primarily to support the slit and thus initially acts as a supporting fluid which then hardens to permanently anchor the sealing wall lamella in place.

As has been noted previously, in recent years, there has been an increased interest in such barrier structures to protect the environment against seepage from waste disposal sites. They are also valuable, of course, in conjunction with mining to prevent water from entering a particular region in which mining activity may be underway. For both of these purposes, the demand for a leakproof barrier has been significant and, therefore, the requirements for such barriers have increased significantly in recent years. In short, conventional or earlier barrier constructions have not been satisfactory because they lack the ability to provide the high degree of long-term guaranteed sealing effectiveness which is required.

In the past, sealing walls have been made from strips of polyethylene and sealing structures of this type have been termed multilayer systems. The individual strips of the sealing wall are formed into continuous barriers with seals between the units. Nevertheless the barrier walls thus created are unsatisfactory for many potential pollutants, for example, chlorinated hydrocarbons which have a significant capability of diffusing through barriers provided with polyethylene strips. Furthermore, sealing walls consisting of polyethylene webs constitute membranes in the physical sense and because of partial pressure on both sides of the membrane, it is not possible to guarantee that there will not be a material transfer across the membrane.

OBJECTS OF THE INVENTION

It is the principal object of the present invention to provide a subterranean barrier for the purposes described which will be free from the drawbacks of earlier barriers.

Another object of this invention is to provide a sealing barrier which ensures practically a permanent and total seal of a protected region from a source, a fluid against which the protected region is to be shielded and, therefore, a barrier which satisfies all present-day requirements with respect to sealing against diffusion as well as, of course, sealing against fluid transfer by other means.

SUMMARY OF THE INVENTION

We have discovered that it is possible to overcome the drawbacks of sealing barriers provided with polyethylene webs and the like by forming the sealing wall within the slit and embedded in the packing mass, from a plurality of glass panes which are sealed together along joints and are provided in a multipane configuration with spacers between the parallel layers of such glass panes and with the spaces between the panes filled with the packing mass as well.

Thus the sealing barrier according to the invention can comprise:

a substantially vertical subsurface slit excavated in a soil structure;

a fluid-impervious sealing wall received in the slit; and a packing mass filling the slit around the sealing wall and embedding the sealing wall in the slit, the sealing wall comprising:

- a multiplicity of substantially vertical glass panes in mutually parallel spaced-apart relationship defining spaces between them,
- spacer means between the panes holding the panes in the spaced-apart relationship, and
- a filling of the packing mass in the spaces.

In one embodiment of the invention, the glass panes are assembled together with the respective spacers into multipane glass units or panels and these panels are assembled with sealed vertical and horizontal joint structures to form the sealing wall with the panels being substantially contiguous with one another.

In general, it is sufficient to form the multipane glass units or panels as double-pane panels.

According to a preferred embodiment of the invention, the single glass panes of the multiglass panels or units can be glass panes of prestressed glass of the type known as single-pane safety glass.

Of course, multipane units or panels and the sealing walls fabricated therefrom, especially when the glass panes consist of single-pane safety glass or prestressed or tempered glass, are suitable for the purposes of the invention because they are able to take up all of the mechanical stresses which can develop, especially when the units themselves are provided with a compression prestress.

The stresses which such sealing walls can take up without difficulty are those which arise from limited shifting of ground strata in subterranean applications where the forces are applied through the packing mass upon the sealing wall.

In general, the joint constructions for the sealing wall, i.e. both the vertical and horizontal joints should be sufficiently yieldable and preferably elastically yieldable to permit limited shifting of the panels with respect to one another.

The specific structures of the joints should be designed so that a seal is maintained between the contiguous parts of the panels for long periods of time and under all the mechanical stresses which may arise.

For example, we have found it to be advantageous to provide elastic sealing strips of rubber or synthetic resin along the vertical joints between the individual glass panes of adjacent panels, so that between the rubber or plastic strip of each joint, a space is defined which can be filled with a cast bituminous mass.

The horizontal gaps can be filled by rubber or elastic strips which allow each upper panel to rest upon each lower panel, the strips having a width equal to the thickness of the panel and supporting each individual pane of an upper panel along its lower horizontal edge on the upper edge of each individual pane of the lower panel.

In practice, the slit is formed in sections or lengths in the ground and thus it is desirable to form the sealing wall in modular units of a given unit width. In that case, all of the panels which will be vertically aligned with one another can form a unit which is lowered into the slit.

The units can thus have a width equal to the width of the panel or, the panel and the glass panes thereof can have a width equal to that of the unit or of a submultiple thereof. Of course, the width of the units, panels and panes is here measured in the direction of the length of the slit, i.e. the horizontal longitudinal dimension thereof.

It has been found to be advantageous, moreover, to hold the panels of each unit between a pair of common vertical joints together by tension means such as a cable or the like and to mount each unit upon a profile or steel structural shape which rests, in turn, upon a foundation. A pretensioning means of this type has been found to increase the ability of the units of the sealing wall to withstand the mechanical stresses which may arise.

Indeed, the prestress can be so dimensioned and arranged that forces which would otherwise tend to distort the glass panes or panels or units are balanced by the prestress when the units are in place in the sealing wall.

The foundation can be composed of concrete and can have an appropriate reinforcement.

It has been found to be advantageous, moreover, to provide probes in the vertical joints which can effect a monitoring of the sealing effectiveness of the joints and hence can provide a continuous output signalling the reliability of the sealing wall. Indeed, the joints can be provided with tubing or the like which can allow refilling of the joints with sealing materials.

In another embodiment of the invention, the spacers are formed unitarily on the glass panes. In this embodiment, for example, at least two layers of glass panes can be provided in a U-shaped cross section with broad U-webs and narrowed U-flanges, the latter forming the spaces.

In this construction, the flanges of the panes of one row project into the U's of the panes of the other row, i.e. the panes interfit with the spaces between them being filled with the filling mass in the slit.

In a preferred embodiment of the invention, three rows or layers of panes are provided including two outer rows and an inner row. Adjacent panes of the inner row are inverted with respect to one another so that the inner row has a u/n pattern and the flanges of the panes of the outer rows extend into the U's of the panes of the inner row while flanges of the panes of the inner row extend into the U's of the panes of the outer rows.

Here also the spacers of the profiled glass elements in the direction of the rows can bear upon one another either through the intermediary of gap-filling materials or elements or can directly abut one another.

The advantages of the systems of the invention derive from the character of the glass sealing wall, the sealing wall satisfying all of the requirements enumerated above since they prevent passage of all contaminants. Glass, for example, is 1000 times less susceptible to diffusion of chlorinated hydrocarbons than is polyethylene. Furthermore, the sealing wall can withstand all mechanical stresses at least in part largely because of the filling of the spaces between individual panes with the filling mass and because the joint structures are deformable.

BRIEF DESCRIPTION OF THE DRAWINGS

The above objects, features and advantages of our invention will become more readily apparent from the following description, reference being made to the accompanying drawing in which.

DETAILED DESCRIPTION

The barriers of FIGS. 1–5 can be formed in a subterranean geological structure 1 and can serve to protect a region on one side of that structure from percolation and permeation by liquids deriving from the opposite side of the barrier, e.g. to confine the liquids which permeate the geological substructure from a waste-disposal site as an environmental protective measure.

The barrier comprises a slit wall 2 which is formed in a vertical slit **2*a* excavated in the ground from the surface 2*b* and extending downwardly to rock structure 1*a*, for example. Within this slit wall, a sealing wall 3 is mounted and the space between the walls of the slit and the sealing wall can be filled with a packing mass 4. The sealing wall 3** is thus embedded in the packing mass.

Figure 1:
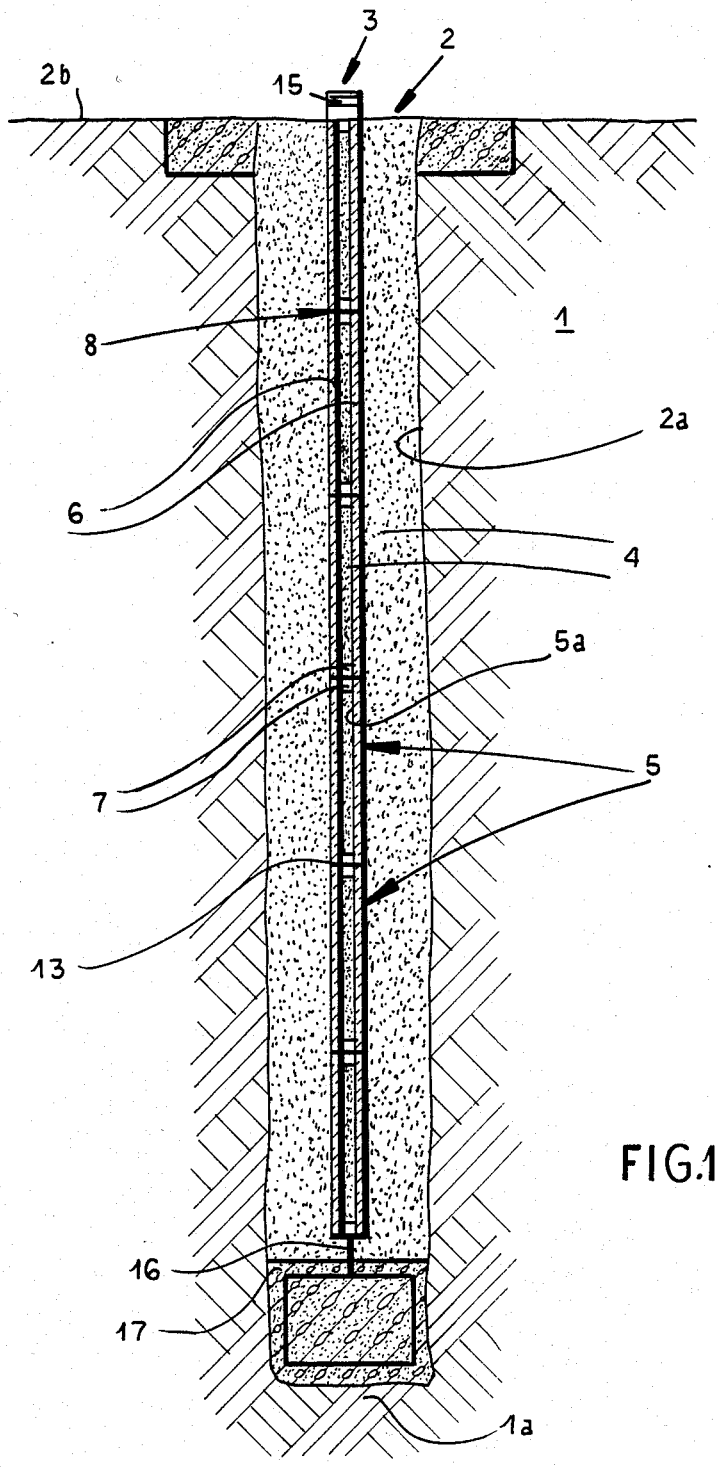
FIG. 1 is a vertical cross-sectional view through a sealing barrier in accordance with the invention.
Figure 2:
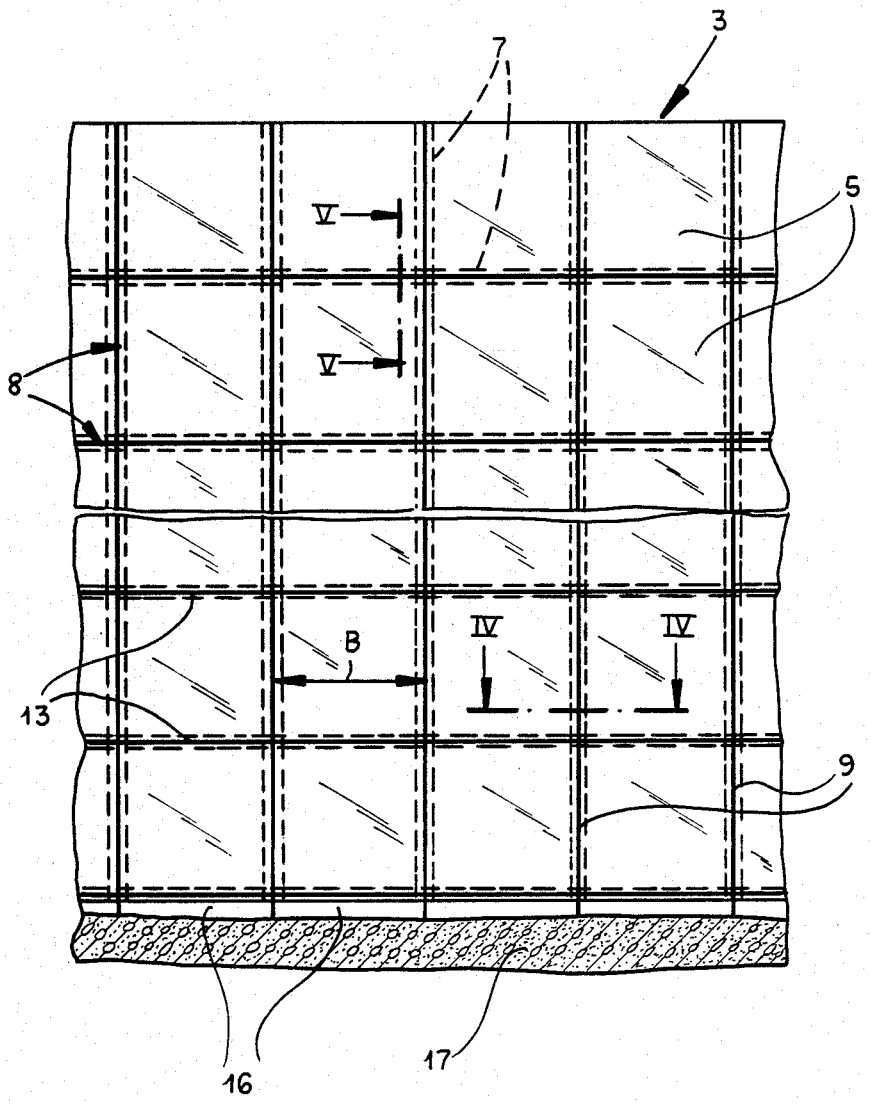
FIG. 2 is a side-elevational view of a portion of the sealing wall of this barrier, the geological subterranean strata having been omitted.

As can be seen from FIGS. 1 and 2, the sealing wall 3 can comprise multipane glass units or panels 3 whose glass panes 6 are spaced apart horizontally by spacers 7 so as to define between them intermediate compartments 5*a* which, in turn, are filled with the packing mass.

The panels 5 are contiguous with one another and defined between them vertical and horizontal joint structures represented generally at 8.

Of course, instead of filling the interiors of the panels with exactly the same packing mass 4 as serves to embed the sealing wall within the slit, a similar or similarly functioning packing member can be provided within the panels. The preferred packing mass is a hardenable composition made up of bentonite, a hydraulic cement and water.

In the embodiment illustrated in FIGS. 1 and 2, and in accordance with a preferred or best-mode embodiment of the invention, each of the panels 5 comprise two individual glass panes 6 (see FIG. 4) joined in a unit with the vertical spacers 7 which can also be composed of glass and can be bonded permanently to the glass panes 6. The horizontal spacers 7″can be metal or synthetic resin profiles which are placed between the glass panes after they have been filled with the packing mass 4.

The individual glass panes can be single-pane glass, i.e. a prestressed or tempered glass.

Figure 4:
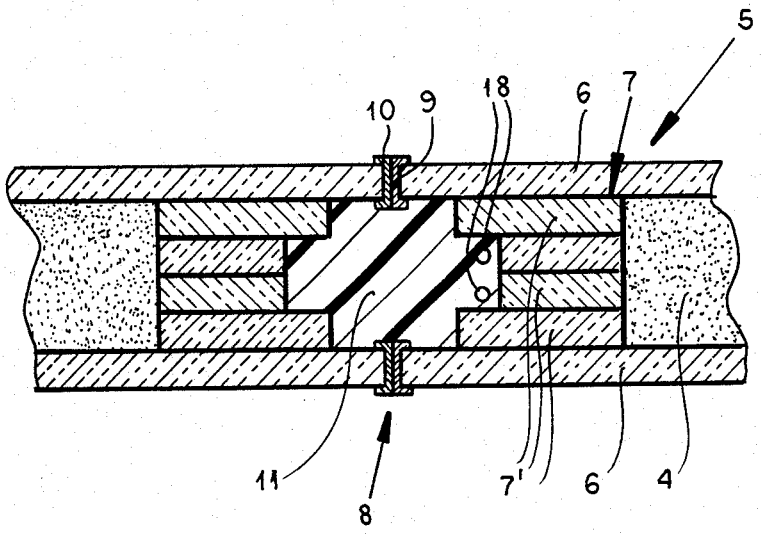
FIG. 4 is a cross-sectional view taken along the line IV—IV of FIG. 2.

As can be seen especially from FIG. 4, the vertical joints 8 can each be formed by a pair of sealing strips 10 of rubber or plastic bonded to the glass panes and bonded to one another where the panels are contiguous with one another. The glass spacer packets 7′, the panes 6 and the sealing strips 10 define along each vertical joint a space which is filled with a bituminous casting mass 11.

Figure 3:
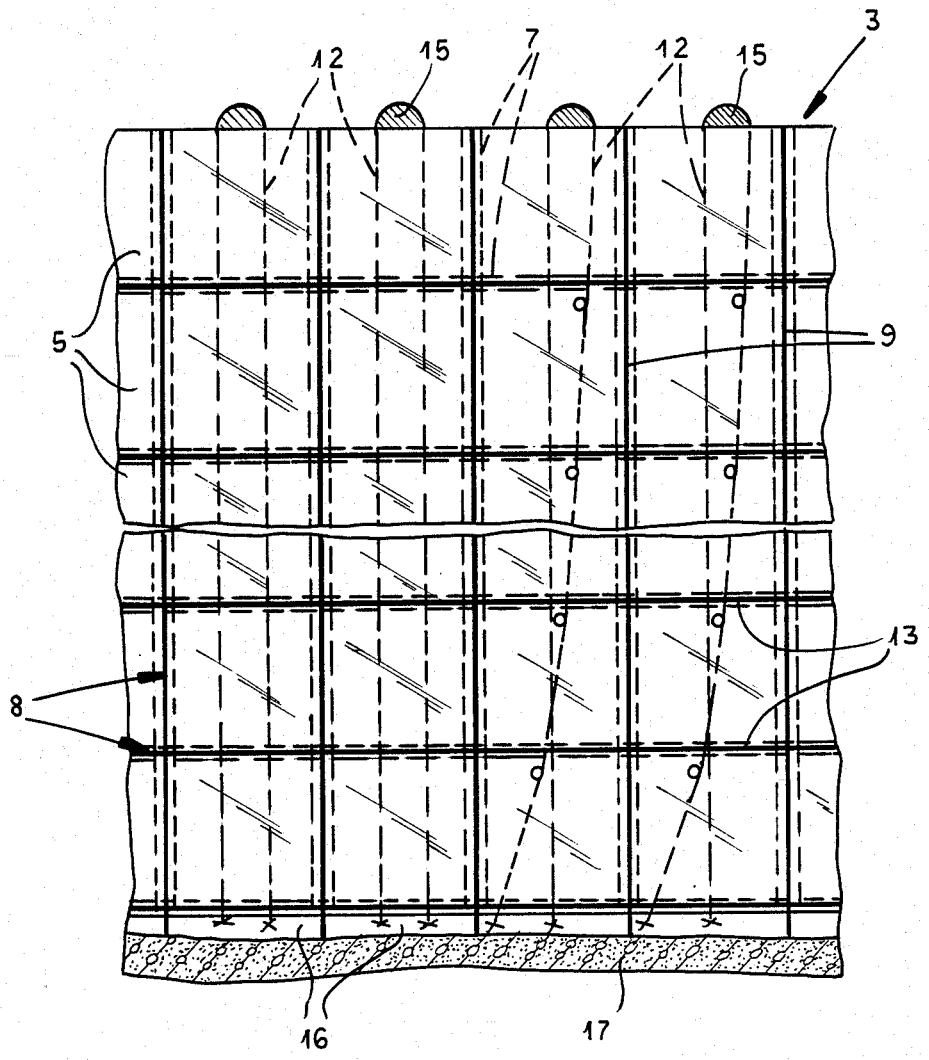
FIG. 3 is a view similar to FIG. 2 but illustrates an alternative embodiment.

As can be seen from FIG. 3, a number of vertically stacked panels 5 can form a respective unit held together by a tension means 12 such as cables running through the spaces between the panes of the panels. The units can thus be lowered by these cables into the slit.

Figure 5:
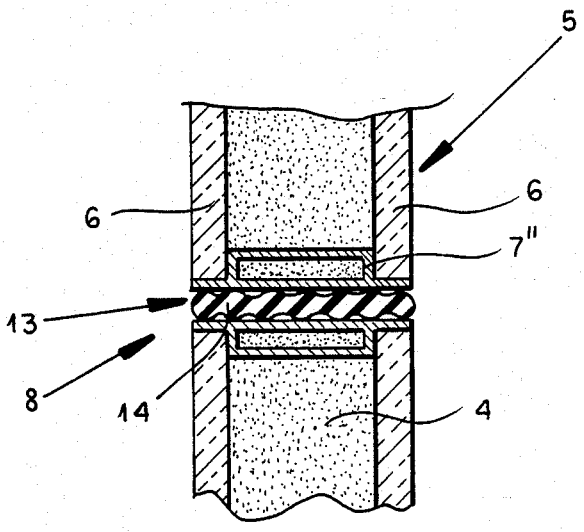
FIG. 5 is a cross-sectional view taken along the line V—V of FIG. 2.

FIG. 5 shows, in greater detail, the horizontal joints 13 forming the horizontal joint structures 8 previously described.

The horizontal joints 13 are constituted by a strip or band of rubber or synthetic resin of a width equal to the thickness of the panels 5. The sealing strip 14 carries the weight of the panels thereabove and is contacted by flat surfaces of the profiled members 7″ previously mentioned.

In the preferred embodiment of the invention (see FIG. 2), the panels 5 have a width B which corresponds to the width of the units lowered into the slit to form the sealing wall between the pair of vertical joints 9 (FIG. 3) so that these units extend the full height of the slit. The panels of each unit are anchored together by the cable 12 which can extend vertically through the spaces between the panes as shown in FIG. 3 at the left-hand side or can have another pattern as shown at the right-hand side of FIG. 3 when the latter pattern is required to prestress the units so as to compensate for mechanical stresses arising in the subterranean barrier.

The units can thus be pretensioned and the cables can pass over saddles 15, the height of which can be selected to adjust the pretensioning force.

Below the bottom-most panel 5, a base member 16, i.e. a steel profile or structural shape is provided, to which the tension element 12 can be anchored and with which each unit rests on a steel-reinforced foundation formed in the bottom of the slit.

In FIG. 4 we have also shown probes 18 arranged in the vertical gap structures 8 to signal leakage through the barrier.

Figure 6:
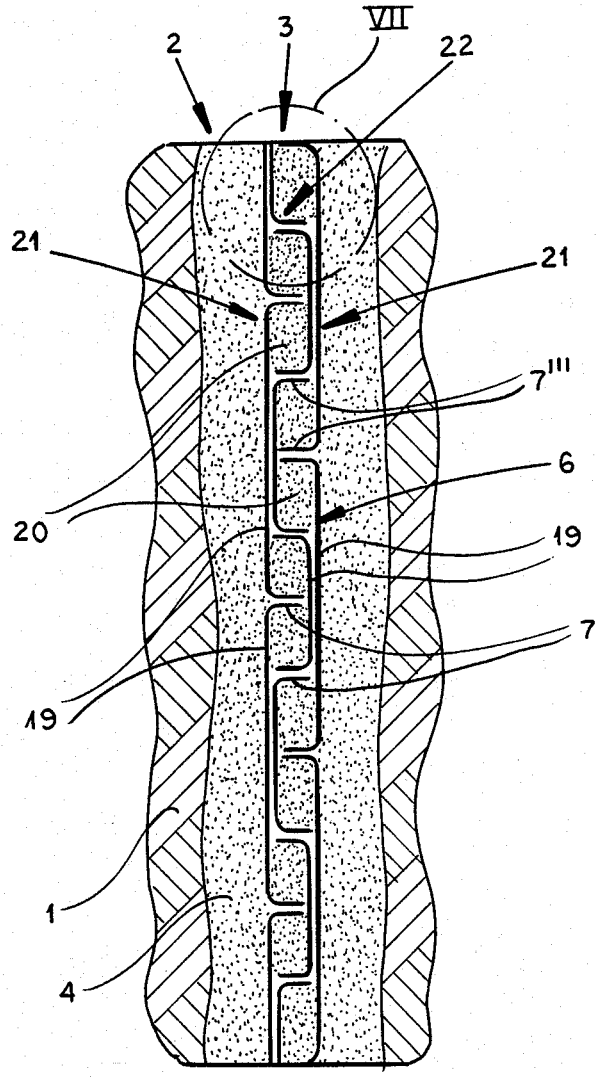
FIG. 6 is a diagrammatic horizontal cross-section through the barrier of an embodiment of the invention.
Figure 7:
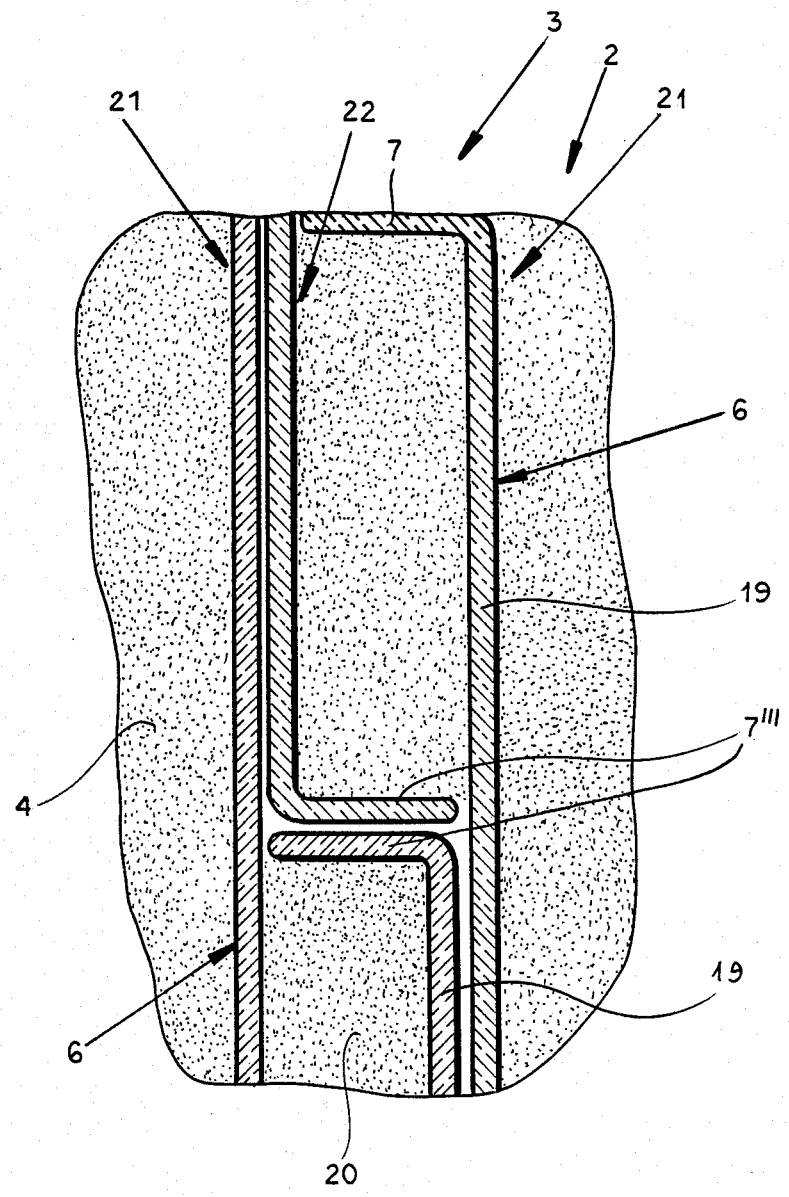
FIG. 7 is a detail view of the region VII of FIG. 6.

In FIGS. 6 and 7 we have shown another embodiment of the barrier in which glass panes 6 are formed unitarily with the spacers 7‴. The glass panes thus are U-shaped with long U-webs and correspondingly long profile chambers 20, and short U-flanges forming the spacers 7‴.

The profile glass elements 6,7‴, 19 are oriented vertically and are provided in at least two rows so that the flanges 7‴ of the panes of the one row engage in the profile chambers of the panes of a second row.

Preferably, however, and as best seen in FIG. 7, three rows of panes are provided, namely, two outer rows 21 (FIG. 6) and an inner row 22. The inner row is composed of profile glass elements which are narrower and are alternately oriented in opposite directions, i.e. in a small-u/small-n pattern. The flanges of the outer rows thus engage in alternate ones of the panes of the inner row and overlap the latter.

Although the horizontal joints are not seen here, it will be understood that they too can be provided with rubber or synthetic resin strips to connect the panes contiguously. The construction of FIGS. 6 and 7 is seen to be substantially symmetrical with the spaces between the panes being filled with the packing mass.

We claim:

1. A subterranean sealing barrier to fluid passage, comprising:

a substantially vertical subsurface slit excavated in a soil structure;

a fluid-impervious sealing wall received in said slit; and a packing mass filling said slit around said sealing wall and embedding said sealing wall in said slit, said sealing wall comprising:

a multiplicity of substantially vertical glass panes in mutually parallel spaced-apart relationship defining spaces between them, spacer means between said panes holding said panes in said spaced-apart relationship, and a filling of a packing mass in said spaces.

2. The subterranean sealing barrier defined in claim 1 wherein the spaced-apart glass panes and respective spacers of said spacer means form panels, said panels being assembled substantially contiguously to form said sealing wall with vertical and horizontal gap-filling joints between said panels.

3. The subterranean sealing barrier defined in claim 2 wherein each of said panels is a double-glass pane panel.

4. The subterranean sealing barrier defined in claim 2 wherein each of said panes is a single prestressed glass pane.

5. The subterranean sealing barrier defined in claim 2 wherein the gap-filling vertical joints each include a pair of sealing strips of rubber or synthetic resin bridging between adjacent panels and defining a compartment between them, and a cast bituminous mass filling the respective compartment.

6. The subterranean sealing barrier defined in claim 2 wherein the gap-filling horizontal joints comprise sealing strips of rubber or synthetic resin having a width substantially equal to the thickness of the panels and separating an upper panel from a lower panel, said strips being sandwiched between said upper and said lower panels and supporting the upper panel on the lower panel.

7. The subterranean sealing barrier defined in claim 2 wherein said panels are prefabricated substantially identical units each having a plurality of pairs of spaced-apart panes and assembled into said sealing wall, said panes being of modular dimensions with equal widths (B) such that the width (B) is a submultiple of the width of said units.

8. The subterranean sealing barrier defined in claim 2 wherein said panels are prefabricated substantially identical units each having a plurality of pairs of spaced-apart panes and assembled into said sealing wall, said panes being of modular dimensions with equal widths (B) such that the width (B) is equal to the width of said units.

9. The subterranean sealing barrier defined in claim 2 wherein a multiplicity of said panels in vertically aligned relationship having common vertical joints are joined together by common tension means to form a unit which can be suspended in the slit, said tension means spanning the height of each said unit.

10. The subterranean sealing barrier defined in claim 9 wherein each of said units between common vertical joints thereof is mounted on a support profile upon a foundation formed at a bottom of said slit.

11. The subterranean sealing barrier defined in claim 2, further comprising probes in said vertical joints for monitoring sealing effectiveness of the sealing wall.

12. The subterranean sealing barrier defined in claim 1 wherein said spacer means includes flanges formed unitarily on said glass panes, whereby each of said glass panes has a generally U-shaped cross section with a broad U-web and a pair of narrow U-flanges, said flanges and panes being oriented vertically in at least two rows having respective U-sections opening in opposite directions and the flanges of the panes of one row extending into the U-sections of the other row.

13. The subterranean sealing barrier defined in claim 12 wherein said panes are provided in three rows, including two outer rows and an inner row with the panes of said inner row alternating in orientation in a u/n pattern and the flanges of the panes of one of said outer rows extending into the U-sections of the panes of the inner row.

14. The subterranean sealing barrier defined in claim 12 wherein the flanges of successive panes in each row are separated from one another by gap-sealing elements.

15. The subterranean sealing barrier defined in claim 12 wherein the flanges of successive panes in each row directly abut one another.

* * * * *

UNITED STATES PATENT AND TRADEMARK OFFICE

CERTIFICATE OF CORRECTION

PATENT NO. : 4,844,662

DATED : 4 July 1989

INVENTOR(S) : Dietmar KALLINICH et al

It is certified that error appears in the above-identified patent and that said Letters Patent is hereby corrected as shown below: On the title page:

Item [73] Assignee's name is to read:

--Flachglas Aktiengesellschaft --.

Signed and Sealed this

Eighteenth Day of June, 1991

*Attest:*

HARRY F. MANBECK, JR.

*Attesting Officer*

*Commissioner of Patents and Trademarks*